United States Patent [19]

Hunt

[11] Patent Number: 4,781,633

[45] Date of Patent: Nov. 1, 1988

[54] RETRACTABLE DRIVE MECHANISM FOR MARINE VESSELS

[76] Inventor: Milby N. Hunt, 19 Manor Way, Galveston, Tex. 77550

[21] Appl. No.: 81,617

[22] Filed: Jul. 30, 1987

Related U.S. Application Data

[63] Continuation of Ser. No. 918,839, Oct. 14, 1986, abandoned, which is a continuation of Ser. No. 677,236, Dec. 3, 1984, abandoned.

[51] Int. Cl.[4] ..... B63H 5/12

[52] U.S. Cl. ..... 440/64; 440/54; 440/57; 440/63; 440/62; 114/162; 114/163; 16/263; 16/271

[58] Field of Search ..... 440/49, 51, 53–55, 440/57–60, 62–64, 66; 114/167, 144 R, 144 A, 162, 163, 169, 254, 267, 263, 270, 271

[56] References Cited

U.S. PATENT DOCUMENTS

| | | | |
|---|---|---|---|
| 132,991 | 11/1872 | Thomas | 114/167 |
| 351,135 | 10/1886 | Sylven | 440/64 |
| 1,802,351 | 4/1931 | Neumann | 440/64 |
| 1,845,712 | 2/1932 | Jacques | 440/64 |
| 2,384,436 | 9/1945 | Bossen | 440/64 |
| 2,922,388 | 1/1960 | Smith | 440/64 |
| 2,923,270 | 2/1960 | Travis | 440/64 |
| 4,078,276 | 3/1978 | Wunes | 16/271 |
| 4,284,025 | 8/1981 | Eckhard | 114/167 |

FOREIGN PATENT DOCUMENTS

| | | | |
|---|---|---|---|
| 609135 | 11/1960 | Canada | 440/64 |

*Primary Examiner*—Sherman D. Basinger
*Assistant Examiner*—Clifford T. Bartz
*Attorney, Agent, or Firm*—Browning, Bushman, Zamecki & Anderson

[57] ABSTRACT

Disclosed is a drive assembly for mounting on a marine vessel, movable between first and second configurations. In the first configuration, the drive assembly, which may include a propeller, is at least partially withdrawn from the water. In the second configuration, the drive assembly is linked to a power source carried by the vessel whereby the drive assembly may be operated to drive the vessel relative to the water. A steering linkage to a steering mechanism may also be provided whereby, with the drive assembly in the second configuration, the drive assembly is linked to the steering mechanism so that the propeller is oriented by operation of the steering mechanism to at least assist in steering the vessel through the water.

54 Claims, 6 Drawing Sheets

FIG. 1
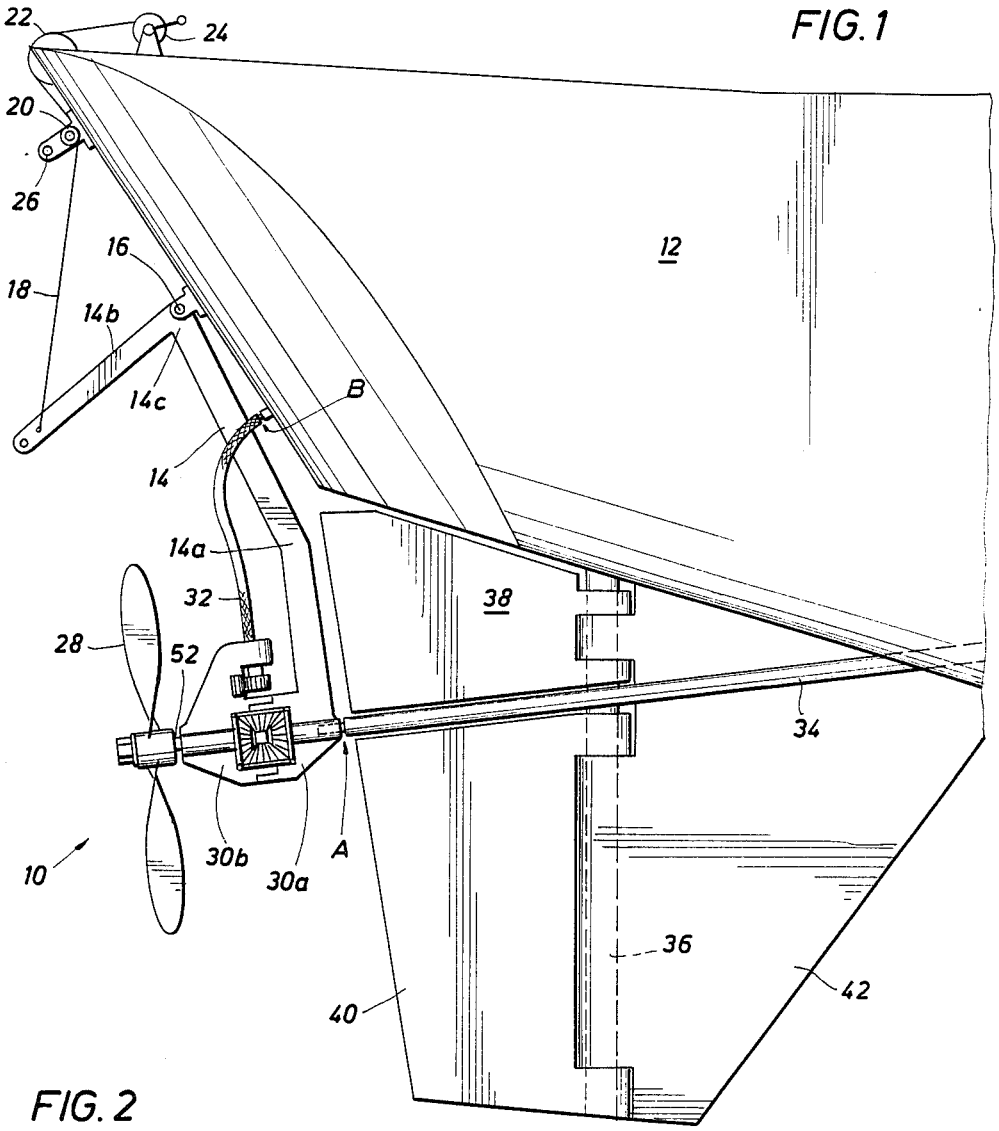
FIG. 2
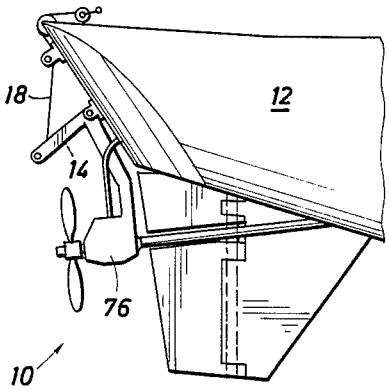
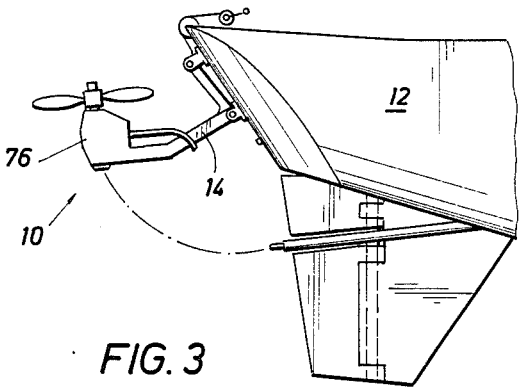
FIG. 3

FIG. 8
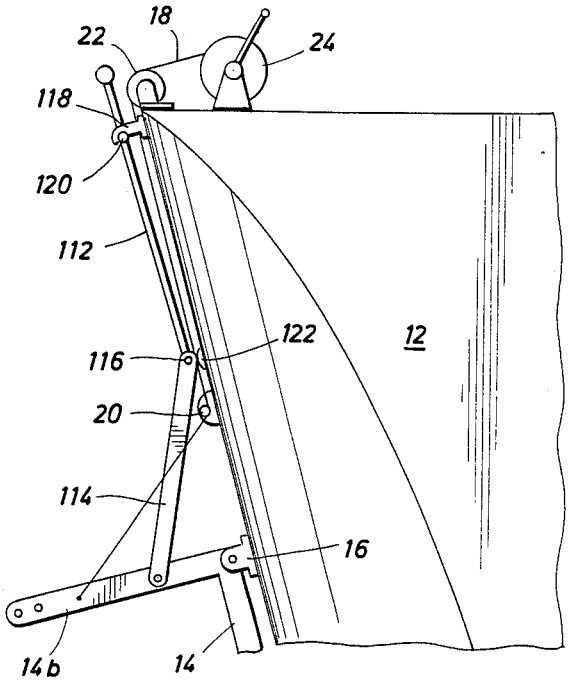
FIG. 9
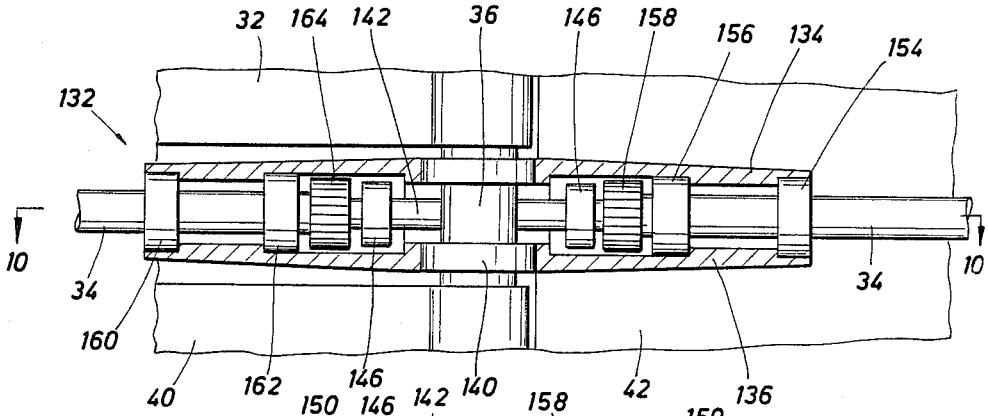
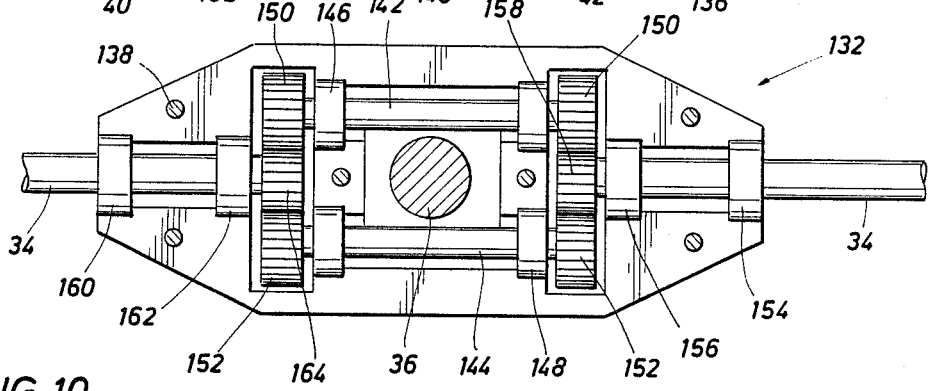
FIG. 10

FIG. 11
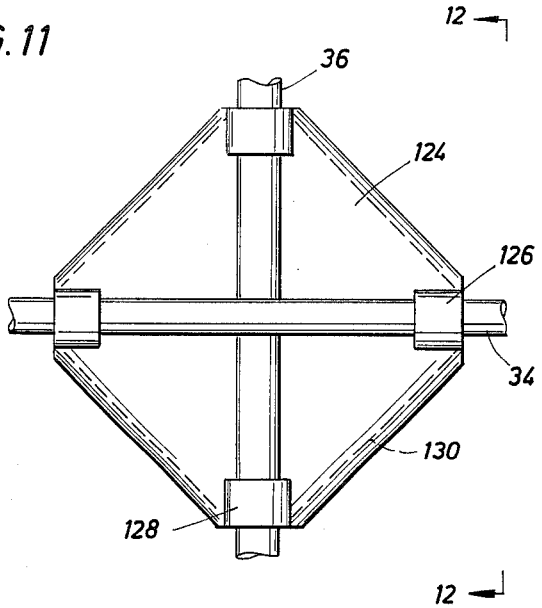
FIG. 12
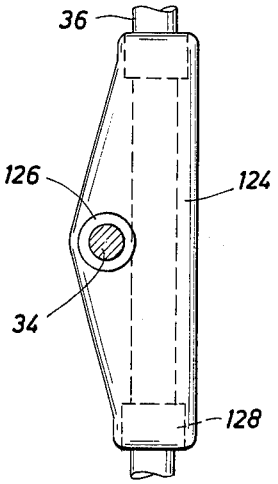
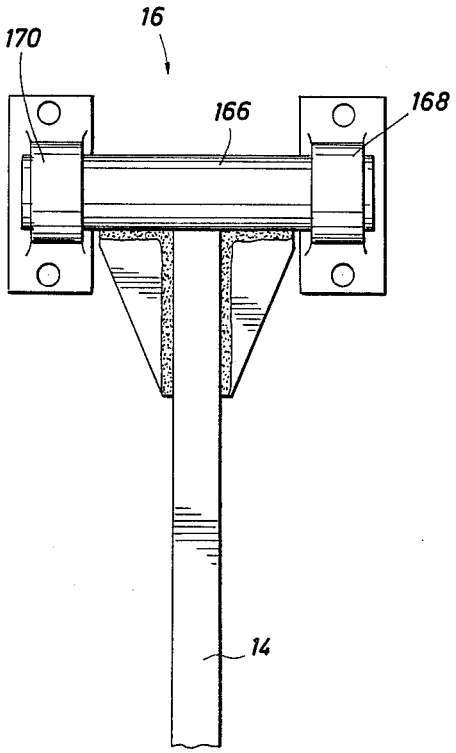
FIG. 13
FIG. 14
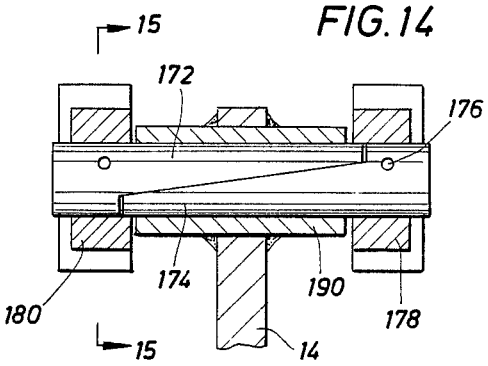
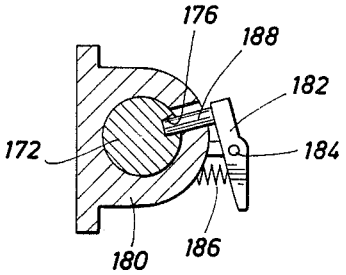
FIG. 15

RETRACTABLE DRIVE MECHANISM FOR MARINE VESSELS

This is a continuation of co-pending application Ser. No. 918,839 filed on Oct. 14, 1986 now abandoned; which is a continuation of Ser. No. 677,236 filed Dec. 3, 1984, now abandoned.

BACKGROUND OF THE INVENTION

1. Field of the Invention

The present invention pertains to apparatus for maneuvering marine vessels in bodies of water. More particularly, the present invention relates to drive apparatus for maneuvering vessels through water wherein the drive mechanism is at least partially retractable above the water line when not in use.

2. Brief Description of Prior Art

In addition to an inboard motor rotating an elongate drive shaft to turn a propeller for propelling boats and ships of all sizes, two other types of mechanical drive mechanisms are available, at least for small craft. These include outboard motors, in which a motor supports a propeller assembly suspended on a rigid mounting extending down into the water, wherein rotation of the entire motor causes rotation of the propeller assembly to steer the craft. Inboard-outboard motors feature a motor permanently mounted inboard and linked to a propeller assembly mounted on an arm extending downwardly below the water line and turnable for steering. Outboard motors may be tilted so that the suspended propeller assembly may be lifted out of the water. The arm supporting the propeller driven by an inboard-outboard motor may be rotated to lift the propeller out of the water. However, in the case of a standard inboard motor, the propeller is mounted on the underwater drive shaft and is not readily accessible from above the water line.

An outboard motor does not have the advantages of ease of accessibility and wide range of sizes featured by an inboard motor, and is further hampered with the hazards and inconvenience of being supported on the stern transom of a boat. An inboard-outboard motor may be larger in size than an outboard motor, but provides a drive linkage that extends through the stern transom of the boat to be angled downwardly with the propeller submerged. On the other hand, the propeller assembly of an inboard motor may not be readily retrieved above the water line for servicing and removal of debris, for example. Additionally, it is inconvenient under other circumstances to have the propeller assembly below the water line, such as in the case of vessels under sail wherein the auxiliary motor is not being used to propel the craft, during which time the propeller assembly may provide a considerable drag against movement of the vessel through the water.

It is desirable and advantageous to have available the convenience and other advantages of an inboard motor coupled with the convenience and other advantages of a retractable drive assembly, and such are provided by the present invention.

SUMMARY OF THE INVENTION

The present invention provides apparatus for driving marine vessels through water, including a drive assembly mounted on such a vessel and movable between a first configuration, in which the drive assembly is at least partly withdrawn or retracted above the water line, and a second configuration in which the drive assembly is connected to a drive linkage to a power source carried by the vessel for operation of the drive assembly. The drive assembly may be pivotally mounted on a lever arm whereby the mounting and drive assembly may be selectively moved between the first and second configurations. Latching apparatus may be provided for locking the drive assembly and mounting mechanism in the first configuration and/or the second configuration. The mounting of the lever arm on the vessel may be by a pivot device, such as a pivot pin. The pivot pin may be provided as a two-part pin assembly whereby the two pin portions cooperate to form an axle, but may be separated in different directions to free the mounting mechanism from the vessel.

The drive assembly may include a propeller and also a gear assembly for connecting the propeller ultimately to the drive linkage in the second configuration. The present invention may also include a steering linkage for connecting the drive assembly, in its second configuration, to steering mechanism carried by the vessel for steering the vessel relative to the water.

When such a steering linkage is included in the invention, the propeller may be selectively oriented by operation of the steering mechanism to at least assist in steering the vessel relative to the water. The propeller may be so made to turn in the steering operation by a gear linkage as part of the drive assembly. A flexible linkage may be utilized to connect the propeller with the steering linkage to the steering mechanism.

A rudder as part of the vessel may include a first, or upper portion, located generally above the drive linkage and movable relative thereto in the steering operation, and a second, or lower rudder portion located generally below the drive linkage for rotational movement in the vessel steering operation.

The present invention provides a retractable drive assembly which may be at least partially withdrawn above the water line when not in use for moving the vessel relative to the water. In the operating, or second configuration, the drive assembly may automatically connect to the drive linkage and to the steering linkage, where a steering linkage is provided.

BRIEF DESCRIPTION OF THE DRAWINGS

FIG. 1 is a side elevation of the stern portion of a vessel mounting a retractable drive assembly according to the present invention, showing the drive assembly in the operating configuration;

FIG. 2 is a reduced view similar to FIG. 1, but showing the drive assembly covered;

FIG. 3 is a view similar to FIG. 2 but illustrating the drive assembly in the withdrawn, or retracted, configuration;

FIG. 8 is a fragmentary side elevation showing another form of apparatus for locking the drive assembly in the operating configuration;

FIG. 9 is an enlarged, fragmentary, side elevation in partial section of a coupling assembly whereby the drive linkage may bypass the rudder shaft of the vessel;

FIG. 10 is a horizontal cross section taken along line 10—10 of FIG. 9 and illustrating further details of the bypass coupling assembly;

FIG. 11 is a side elevation of another version of a bypass mechanism whereby the drive linkage may lie along side the rudder shaft;

FIG. 12 is an end view, taken along line 12—12 of FIG. 11;

FIG. 13 is an end view of a pivot mounting mechanism according to the present invention;

FIG. 14 is a view similar to FIG. 13, but in partial section and illustrating details of a version of a pivot pin;

FIG. 15 is an end elevation of the pivot mounting mechanism taken along line 15—15 of FIG. 14;

DETAILED DESCRIPTION OF THE PREFERRED EMBODIMENTS

Figure 4:
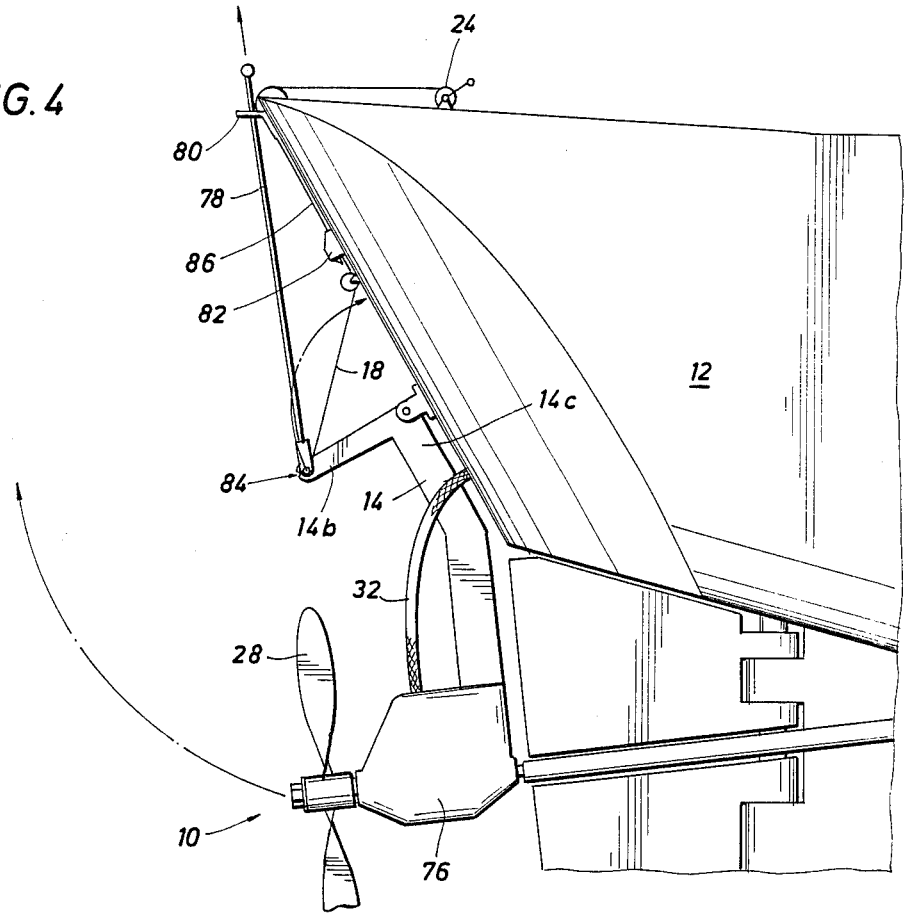
FIG. 4 is a side elevation of a portion of the rear of a vessel mounting a drive assembly according to the present invention, illustrating apparatus for locking the assembly in the retracted configuration.

A drive assembly for propelling a marine vessel according to the present invention is shown generally at 10 in FIGS. 1–3, mounted on the stern of a boat 12. A mounting mechanism 14 includes a lever arm construction comprising a relatively long arm 14*a*, by which the driving assembly 10 is suspended, and a relatively short arm 14*b* with an intervening elbow 14*c*. The mounting components 14*a*, 14*b* and 14*c* may be constructed in any appropriate form, including as an integral unit. A pivot assembly 16, whose construction is considered in further detail hereinafter, provides a hinged connection at the elbow 14*c* to the stern transom of the boat 12.

A flexible cable or the like 18 is connected toward the end of the shorter lever arm 14*b* opposite the elbow 14c, passes around a sheave 20 mounted on the boat 12 and a second sheave 22 at the top edge of the boat and extends to and is operated by a winch 24. As illustrated in FIGS. 1 and 2, the mounting system 14 and the drive assembly 10 are in an operating configuration, wherein the drive assembly is positioned below the water line. If the winch 24 is turned to retract the cable 18, movement of the shorter lever arm 14*b* in a clockwise sense as illustrated in FIGS. 1–3 lifts the mounting system 14 and the drive assembly 10 to a retracted, or inoperative, configuration, with the drive assembly at least partially above the water line, as shown in FIG. 3.

The end of the lever arm 14*b* away from the elbow 14*c* may mesh in a clevis-and-tongue type combination with a locking fixture 26 on the stern of the boat 12 when the drive assembly 10 is in the inoperative, or storage, configuration of FIG. 3 whereby a latch pin or other appropriate device (not shown) may be applied to lock the end of the lever arm 14b to the fixture 26 to secure the drive assembly and mounting system 14 in the inoperative configuration. Such a latch pin or other appropriate device may be spring loaded, for example, so that the lever arm 14*b* automatically locks to the fixture 26 upon movement of the mounting system to the retracted configuration of FIG. 3, but may be released therefrom upon manual operation of the latching mechanism. Various techniques for locking the mounting system 14 and drive assembly 10 in the operating configuration of FIGS. 1 and 2 are discussed hereinafter.

The drive assembly 10 includes a propeller 28 for interacting with the water, and a two-part housing including a forward housing component 30*a* and a rear housing component 30*b*. The forward housing component 30*a* is connected to, or may be an integral part of, the lower, longer mounting lever arm 14*a*. The rear housing unit 30*b* is rotatable relative to the forward housing unit 30*a*, the propeller 28 being oriented for rotation in selected planes accordingly. Details of the interconnection between the two housing units 30*a* and 30*b* as well as the maneuverability of the propeller 28 are discussed in detail hereinafter.

The drive assembly 10 further includes a flexible linkage or the like, 32, which may be provided by a stainless steel mesh cable, for example. As discussed hereinafter, the flexible linkage 23 provides operable connection between the drive assembly 10 and ultimately the sterring mechanism of the boat 12. Similarly, as discussed in detail hereinafter, a drive system carried by the housing units 30*a* and 30*b* provides operative connection between the propeller 28 and a drive linkage, including a drive shaft 34, to the power mechanism (not shown) carried by the boat 12. In the operating configuration of FIGS. 1 and 2, the drive system included in the power assembly 10 is rotationally fixed, by connection at A, to the drive shaft 34. In similar fashion, in the operating configuration of the power assembly 10, the flexible linkage 32 is connected at B to a further steering linkage to the steering control carried by the boat 12.

As illustrated in FIG. 1, the boat 12 may be steered, at least in part, by a two-part rudder mounted on a rudder shaft 36 and including an upper rudder section 38 and a lower rudder section 40, mounted generally above and below, respectively, the drive shaft 34 whereby, on rotation of the rudder shaft 36, the rudder portions 38 and 40 are free to turn without interference from the drive shaft. As illustrated, a keel or skeg 42 extends to the rudder shaft 36.

Figure 5:
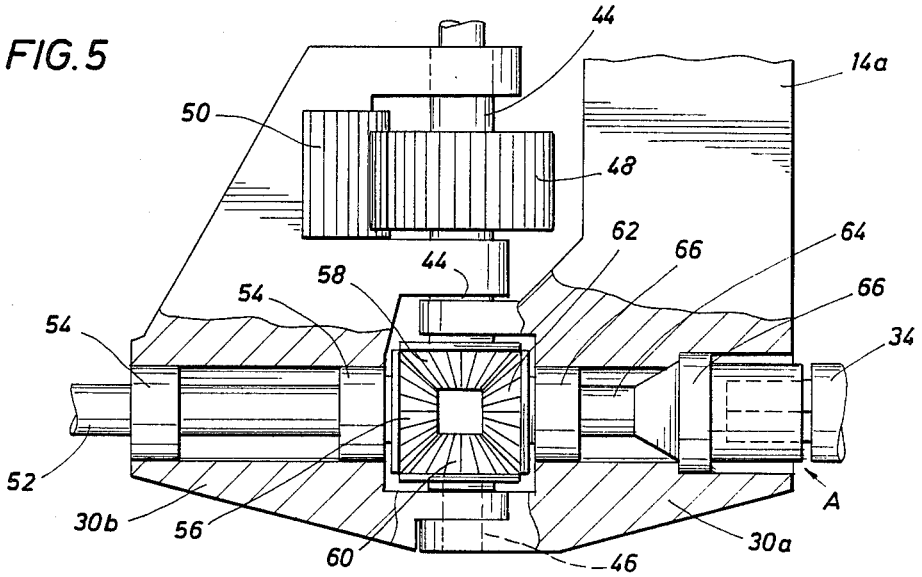
FIG. 5 is an enlarged, fragmentary and broken away view of the steering and drive gear assemblies of the drive assembly illustrated in FIG. 1.

Also as illustrated in FIG. 1, the drive assembly 10 includes two gear assemblies, details of which are visible in FIG. 5. The flexible cable 32 extends to and continues as a rigid shaft 44, coupled to the forward housing unit 30*a*, but looped by the rear housing unit 30*b* in the fashion of a hinge pin. A shaft 46 similarly joins the bottom portions of the forward and rear housing units 30*a* and 30*b*, respectively. Appropriate sealed, pivot bearings (not shown) secure the shafts 44 and 46 to at least the forward housing unit 30*a* while allowing the rear housing unit to be rotational relative to the forward housing unit about the shafts 44 and 46.

The shaft 44 carries a cylindrical steering gear 48, which is meshed with a directional gear 50 fixed to the rear housing unit 30b. Rotation of the linkage provided by the cable 32 to rotate the shaft 44 relative to the forward housing 30*a*, for example, results in rotation of the steering gear 48 relative to the turning gear 50 to accordingly rotate the rear housing unit 30*b* relative to the forward housing unit and the boat 12. As the rear housing 30*b* is so rotated about the steering shaft 44, the propeller 28 has its plane of rotation about its drive shaft rotated relative to the boat 12.

The propeller 28 is mounted on a propeller shaft 52 which is carried by appropriate sealed bearings 54 by the rear housing unit **30*b*, and which ends in a bevel propeller gear 56. Upper and lower bevel drive gears 58 and 60, respectively, connect the propeller gear 56 with a forward bevel power gear 62 by intermeshing of the gears as illustrated. The drive gears 58 and 60 are idler gears on their respective bearing mounts (not visible). The power gear 62 is rotationally fixed to a power shaft 64 carried by the forward housing unit 30*a* in appropriate sealed bearings 66. The union at A is provided by a hexagonal male-and-female joint between an appropriate female extension of the power shaft 64 fitting around and receiving an appropriate male extension of the drive shaft 34 as illustrated. Thus, with the power assembly 10 in the operating configuration with the union A made up, rotation of the drive shaft 34 causes rotation of the power shaft 64 and, through the gears 56–62, rotation of the propeller shaft 52 to cause driving rotation of the propeller 28**.

Figure 6:
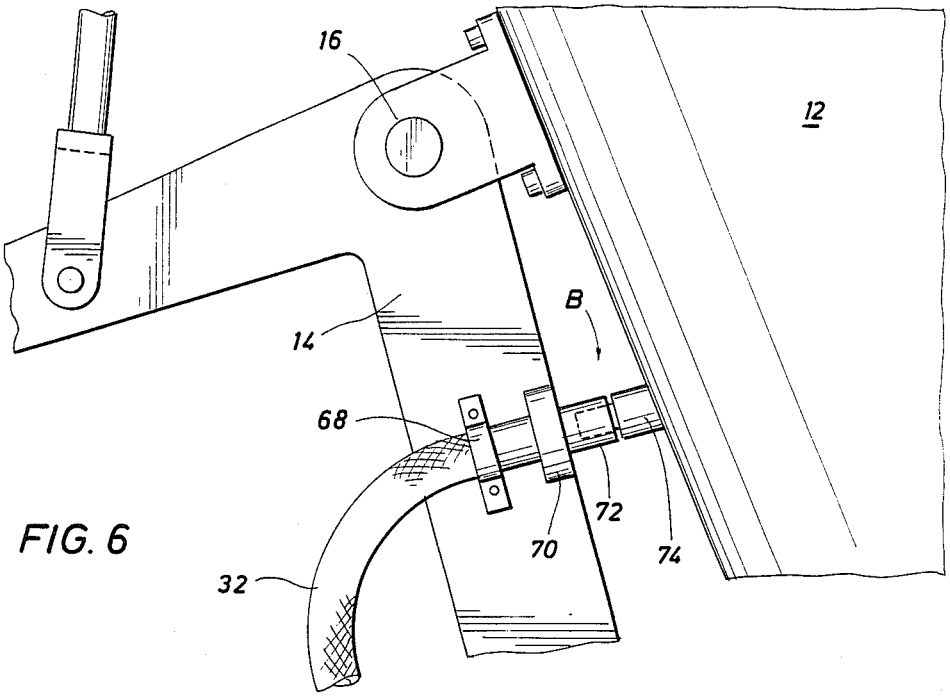
FIG. 6 is an enlarged, fragmentary view showing the connection of the drive assembly to the steering linkage.

In FIG. 6, details of the union at B are illustrated. The mesh cable 32 is held to the mounting lever arm 14 by a clamp 68 with bearings to allow rotation of the cable relative to the clamp. An additional bearing clamp 70, fixed to the lever arm 14, constrains hexagonal female fitting 72 carried by the cable 32. The fitting 72 receives and couples with a hexagonal male extension of a steering linkage shaft 74 which continues to the interior of the boat 12.

It will be appreciated that, as the mounting system 14 swings from the elevated configuration of FIG. 3 to the operating configuration of FIGS. 1, 2, 5 and 6, the couplings at A and B automatically make up with the corresponding female receptacles receiving and linking with the respective male hexagonal extensions whereby rotation of the drive shaft 34 and steering linkage shaft 74 cause corresponding rotation of the propeller shaft 52 and rear power assembly housing unit **30*b*, respectively. As the rear housing unit 30*b* rotates with the steering shaft linkage 74, the propeller shaft 52 and, therefore, the plane of rotation of the propeller 28, turn accordingly. The rudder and the aft housing 30*b* should be amidships when the coupling at B is made up to achieve proper alignment of the propelelr 28** with the rudder.

The gear mechanisms and linkages between the forward housing unit **30*a* and the rear housing unit 30*b*, illustrated in detail in FIGS. 1 and 5, may be enclosed in an appropriate shroud 76, as illustrated in FIGS. 2–4. The shroud 76 may be constructed, at least in part, of a flexible material such as neoprene. The shroud may include appropriate rigid covers, flexibly joined to allow rotation of the rear housing 30*b* relative to the forward housing 30*a*. The shroud 76 may be so constructed as to provide a fluid-tight seal around the housings 30*a* and 30*b*. Additionally, the shape of the power assembly 10** for ease of passage through the water.

In FIG. 4, a push rod 78 is shown pivotally connected toward the end of the upper, shorter lever arm **14*b* away from the elbow 14*c*, and extending upwardly to a keeper bracket 80. The push rod 78 may be manually operated to force the mounting system 14 in a counterclockwise rotational sense, as illustrated in FIG. 4, to ensure proper make up of the unions A and B(FIG. 1) in the operating configuration of the power drive 10. Once the power drive assembly 10 is properly positioned in its operating configuration with the unions A and B made up, the push rod 78 may be locked in the keeper 80 by an appropriate pin (not shown) or other appropriate mechanism. Release of the locking of the push rod 78 at the keeper 80 permits raising of the drive assembly 10 to the retracted configuration of FIG. 3 by operation of the winch 24 to retract the cable 18, and/or by pulling upwardly on the push rod 78**.

A spring loaded locking pin mechanism 82, mounted in an appropriate housing fixed to the stern transom of the boat 12, is received in and latches with an appropriate detente positioned at 84 on the end of the shorter lever arm **14*b* away from the elbow 14*c* when the drive assembly 10 is moved to its retracted configuration of FIG. 3. The locking of the mounting system 14 in the upper configuration by the snapping of the pin 82 into the detente 84 is automatic when the mounting system achieves the retracted configuration of FIG. 3. A line 86 extends from the pin 82 to the upper portion of the boat 12 where it may be manually pulled, for example, to withdrawn the pin 82 from the detent 84 to permit lowering of the power assembly 10** to the operating configuration.

Figure 7:
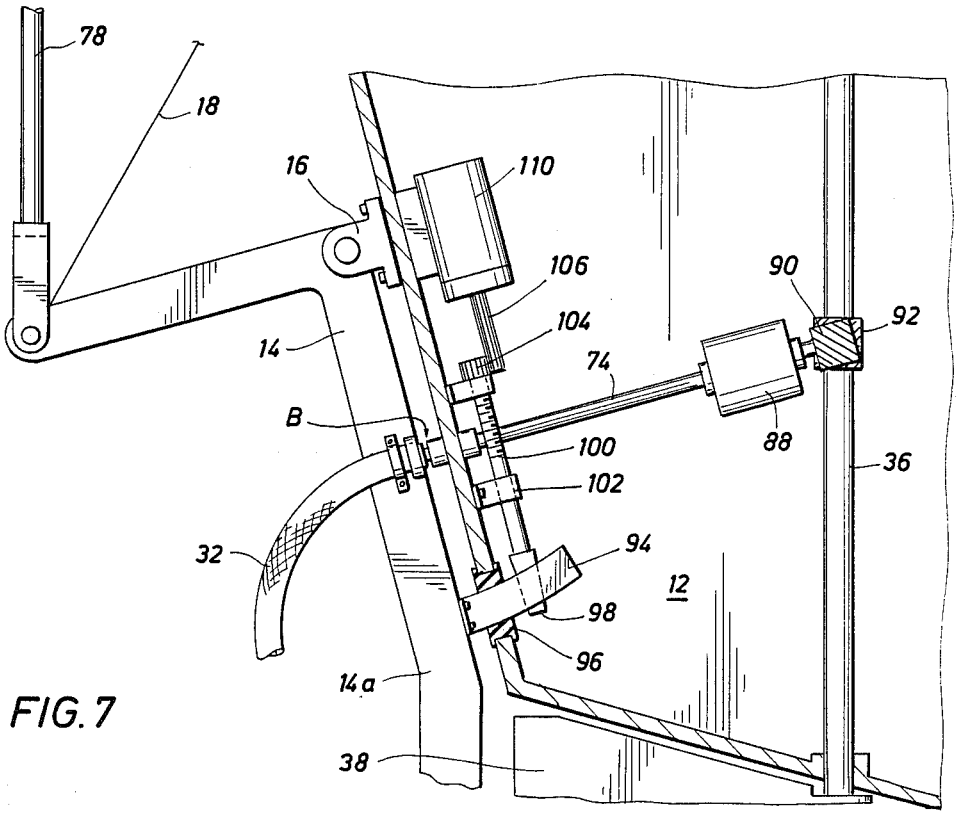
FIG. 7 is an enlarged side elevation in cross section illustrating apparatus for locking the drive assembly in the operating configuration and also showing a steering linkage.

In FIG. 7, details of the steering linkage 74 with the rudder shaft 36 are shown along with a technique for locking the mounting system 14 and, therefore, the drive assembly 10, in operating configuration. The steering shaft linkage 74 continues to a gear box 88, if needed, and by which the linkage may be further supported. The steering linkage ends in a helical gear 90 which meshes with a complementary helical gear 92 mounted on the rudder shaft 36. Thus, rotation of the rudder shaft 36 by an appropriate tiller or steering wheel (not shown) also causes rotation of the steering linkage shaft 74 and the flexible cable mechanism 32 to turn the drive assembly aft housing **30*b* and, therefore, the plane of rotation of the propeller 28**.

As shown in FIG. 7, the longer lever arm **14*a* of the mounting mechanism 14 may carry an arcuate locking arm 94 which automatically passes through a grommet-lined hole 96 in the stern transom of the boat 12 when the drive assembly is moved to the operating configuration. In the operating configuration, the locking arm 94 may receive a wedge 98 in an appropriate hole passing through the locking arm. The wedge 98 is carried on the end of a worm gear 100 carried in appropriately threaded mounting brackets 102. The end of the worm gear 100 opposite the wedge 98 carries a cylindrical gear 104 which is meshed with an elongate cylindrical gear 106 carried by, or as part of, the drive shaft of a motor 110. Operation of the motor 110 to rotate the shaft gear 106 rotates the worm gear 100 which is thus driven longitudinally relative to the brakets 102 to selectively move the wedge 98 longitudinally into or out of the hole of the locking arm 94 to secure the drive assembly in the operating configuration, or to release the drive assembly for movement out of the operating configuration, respectively. An appropriate gear ratio may be provided between the gears 104 and 106, or a gear box (not shown) may be included in the linkage between the motor 110 and the worm gear 100. A manual override (not shown) of the motor 110, operable by a crank for example, may be provided to manipulate the wedge 98 in the event of a power failure. The grommet lining of the transom hole 96 provides appropriate fluid-tight sealing aroung the locking arm 94**, and, with the locking arm removed with the drive assembly out of the operating configuration, to simple close the hole.

Yet another technique for locking the mounting mechanism and drive assembly in the operating configuration is illustrated in FIG. 8 (wherein the appraratus for latching the drive mechanism in the non-operating configuration is not shown for purposes of clarity). An eccentric arm assembly including an upper arm 112 and a lower arm 114 joined at a hinge 116 is connected to the shorter lever arm **14*b* and extends upwardly to be manually operated from within the boat 12, for example. A downwardly-facing locking hook 118 is carried on the stern of the boat 12 and may receive a pin 120 carried on the upper arm 112. With the pin 120 free of the locking hook 118, the upper arm 112 may be manually operated to assist in raising the mounting mechanism 14 from the operating configuration and may be manipulated to push the mounting mechanism and the drive assembly to the operating configuration, in generally the same manner as the push rod 78** may be operated as described hereinbefore.

With the mounting mechanism 14 seated in the operating configuration as illustrated in FIG. 8, the upper arm 112 may be manipulated to pivot relative to the lower arm 114, forcing the hinge 116 toward the stern transom of the boat 12 and against a resting pad 122, for example. Further manipulation of the upper arm 112 may be utilized to hook the pin 120 within the curvature of the locking hook 118 provided for that purpose, thus releasably locking the combination of the upper arm 112 and the lower arm 114 in the bent configuration illustration in 118. It will be appreciated that movement of the mounting system 14 out of the operating configuration is then prevented, since such movement would merely tend to drive the lower arm 114 upwardly and against the pad 122, and the upper arm 112 upwardly to press the pin 120 against the locking hook 118. The mounting system 14 may be freed for movement out of the operating configuration by manipulation of the upper arm 112 to unlatch the pin 120 from the locking hook 118, whereby the upper arm and the lower arm 114 may be flexed and are free to be moved upwardly with the mounting system. The pad 122 may be appropriately resilient, if necessary, to allow sufficient movement of the hinge 116 toward the boat 12 for manipulation of the pin 120 into and out of locking engagement with the locking hook 118.

The drive shaft 34 may be offset from the rudder shaft 36, as illustrated in FIG. 1 for example. In that case, the propeller 18 would also be offset from the rudder 38 and 40, unless the drive assembly 10 included an additional gear assembly (not shown) to accommodate offset of the drive shaft 34 from the propeller shaft 52, for example. For purposes of stability, a bracket assembly 124 as illustrated in FIGS. 11 and 12 may be employed. The bracket 124 may be constructed utilizing opposed plates, for example. The plates may be shaped around the shafts 34 and 36. Sealed bearings 126 and 128 seal the brackets 124 to the shafts 34 and 36, respectively. A gasket 130 extends about the bracket 124 and completes the fluid-tight sealing of the components thereof. The bracket assembly 124 prevents longitudinal movement of the shafts 34 and 36 away from each other or toward each other, preventing contact between the shafts due to vibration, for example, yet allows independent rotation of the shafts about their respective axes.

A coupling assembly is shown generally at 132 in FIGS. 9 and 10 whereby the drive shaft 34 and the rudder shaft 36 may be mutually aligned, that is, provided generally in the same plane. The coupling assembly 132 includes a housing which may be provided by upper and lower housing members 13 4and 136, respectively, held together by appropriate bolts 138, for example. The heads of the bolts 138 may recess within the housing portions 134 and 136, and the bolts can be locked in place by the lock rings (not shown) secured over the bolts heads. The housing portions 134 and 136 may be streamlined, for example, and shaped around the shafts and other components they enclose.

The rudder shaft 36 may continue unbroken through the coupling assembly 132, and be connected thereto by means of sealed bearings 140 carried by the respective housing portions 134 and 136. The drive shaft 34 is broken within the coupling assembly 132, but continued therethrough by twin connector shafts 142 and 144 flanking the rudder shaft 36. The coupling shafts 142 and 144 are carried on bearings 146 and 148 at the respective ends of the coupling shafts. Additionally, the ends of each coupling shaft 142 and 144 carry cylindrical gears 150 and 152, respectively.

The drive shaft 34 enters the forward end of the coupling assembly 132 through an appropriate seal 154, and is mounted on a bearing 156. A cylindrical gear 158 is carried at the end of the forward portion of the drive shaft 34, and meshes with the gears 150 and 152 carried by the forward ends of the coupling shafts 142 and 144, respectively. The aft portion of the drive shaft 34 similarly enters the coupling assembly 132 through an appropriate seal 160, is mounted in an appropriate bearing 162, and carries a cylindrical gear 164 which meshes with the gears 150 and 152 carried on the aft ends of the coupling shafts 142 and 144, respectively. Thus, rotation of the forward portion of the drive shaft 34 by the motor (not shown) carried by the boat 12 causes rotation of the drive shaft gear 158 to rotate the coupling gears 150 and 152 meshed therewith. The coupling shafts 142 and 144 are accordingly rotated to rotate their respective aft gears 150 and 152, causing rotation of the aft drive shaft gear 164 and the aft portion of the drive shaft 34. Such drive shaft rotation occurs independently and without contact of any of the drive shaft coupling components with the rudder shaft 36, which may be appropriately rotated within the coupling assembly 132 independently of operation of the drive shaft 34.

The coupling assembly 132 thus provides an operative bypass between the drive shaft 34 and the rudder shaft 36 whereby both shafts may be provided in line generally in the same plane so that the propeller 28 may be appropriately aligned with the rudder 38 and 40 relative to the boat 12. Although the rudder shaft 36 is shown unbroken and the coupling assembly 132 providing a gear train in the driver shaft 34, the coupling could be applied to the rudder shaft with the drive shaft passing unbroken through a rudder shaft gear train.

Figure 16:
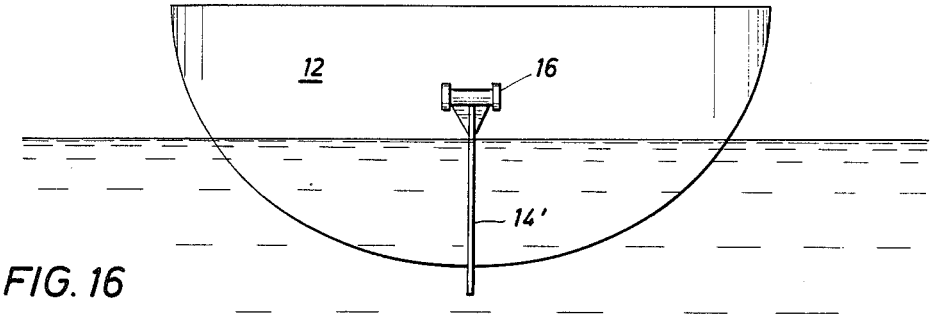
FIG. 16 if a rear view of a vessel carrying a drive assembly according to the present invention and illustrating details of the lever arm mounting.
Figure 17:
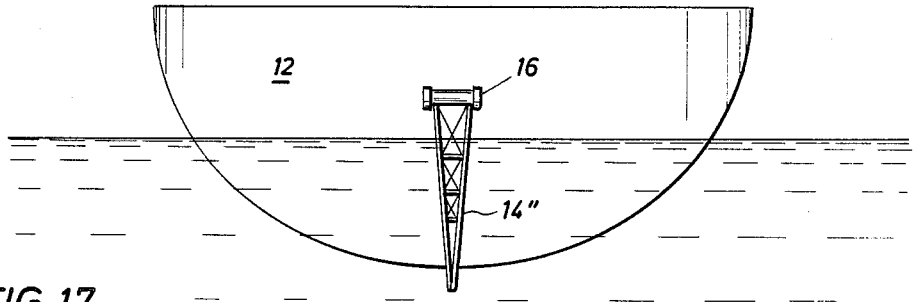
FIG. 17 is a view similar to FIG. 16 but illustrating another version of the mounting lever arm.

The mounting assembly 14, including the two arm portions **14*a* and 14*b*, may be constructed in a variety of forms suitable to the drive assembly carried thereby and the boat on which the drive assembly is mounted, for example. FIG. 16 shows a generally single beam construction of a mounting system 14' attached to a boat 12 by the hinge assembly 16. FIG. 17 shows a structured beam construction for a mounting system 14" similarly carried by a boat 12 by means of the hinge assembly 16. The structured beam assembly 14"** may be provided where greater strength is needed, in the case of larger drive assemblies, for example.

The hinge assembly is shown generally at 16 in FIG. 13 wherein it may be appreciated that the hinge may include a shaft 166, appropriately welded to the mounting system arm assembly 14, and carried in appropriate bearing brackets 168 and 170. Alternatively, the hinge mechanism may include a pin carried in brackets without bearings, with the pin enclosed in a sleeve fixed to the mounting system 14. Such a construction is illustrated in FIGS. 14 and 15, wherein a hinge pin is provided in two parts 172 and 174 which combine to form a cylindrical construction. Each pin portion 172 and 174 includes a bore 176. Brackets 178 and 180 are provided fixed to the boat 12 (not shown). With the pin members 172 and 174 assembled as illustrated, the pin bores 176 are aligned with the brackets 178 and 180, respectively. Each bracket carries a latching mechanism including a lever arm 182 carried on a hinge 184 and springbiased by a spring mechanism 186 to maintain a pin 188 sunk in the corresponding hinge pin hole 176. The brackets 178 and 180 are appropriately bored to accommodate movement of the latching pins 188 into and out of the hinge pin bores 176 which are aligned with the bracket bores. The mounting system 14 carries a laterally-extending sleeve 190 within which the combined pin members 172 and 174 may be positioned. The pin thus assembled by the members 172 and 174 provides a hinge pin about which the sleeve 190 is free to rotate to permit movement of the mounting system 14 relative to the boat 12 while maintaining the mounting system pivotally latched to the boat.

The hinge pin components 172 and 174 may be assembled as illustrated with the mounting system sleeve 190 placed between and aligned with the brackets 178 and 180, and the latching pins 188 snapped into place in the hinge pin bores 176. To release the mounting system 14 from the boat 12, the hinge pin components 172 and 174 may be released from the respective locking configurations by depression of the lever arms 182 to compress the springs 186 and withdraw the latch pins 188 from the bores 176. Thereafter, the pine components 172 and 174 may be simultaneously withdrawn from the mounting system sleeve 190 in opposite directions, the portion 172 being moved to the left and the portion 174 being moved to the right as viewed in FIG. 14, for example. Such removal of the hinge pins in opposite directions releases the mounting system 14 from the boat 12 without any tendency of the mounting system to rotate relative to the boat. Such rotation might result if the hinge pin were provided as a single component and was released by withdrawing the hinge pin entirely to one side or the other out of the mounting system sleeve 190, for example. A tendency of the mounting system 14 to rotate relative to the boat 12 due to the system's own weight, for example, may provide difficulties in handling the mounting system and associated drive assembly, particularly in emergency situations. Additionally, a split hinge pin as illustrated in FIGS. 14 and 15 that may be withdrawn from the mounting system sleeve 190 in opposite directions provides a quick release of the mounting system 14 from the boat 12 in emergency situations. To facilitate removal of the hinge pin components 172 and 174 from the sleeve 190 and the brackets 178 and 180, the hinge pin components may be further provided with holes or other such appropriate devices whereby lanyards may be attached to the opposite, external ends of the hinge pin components for pulling the components apart.

Figure 18:
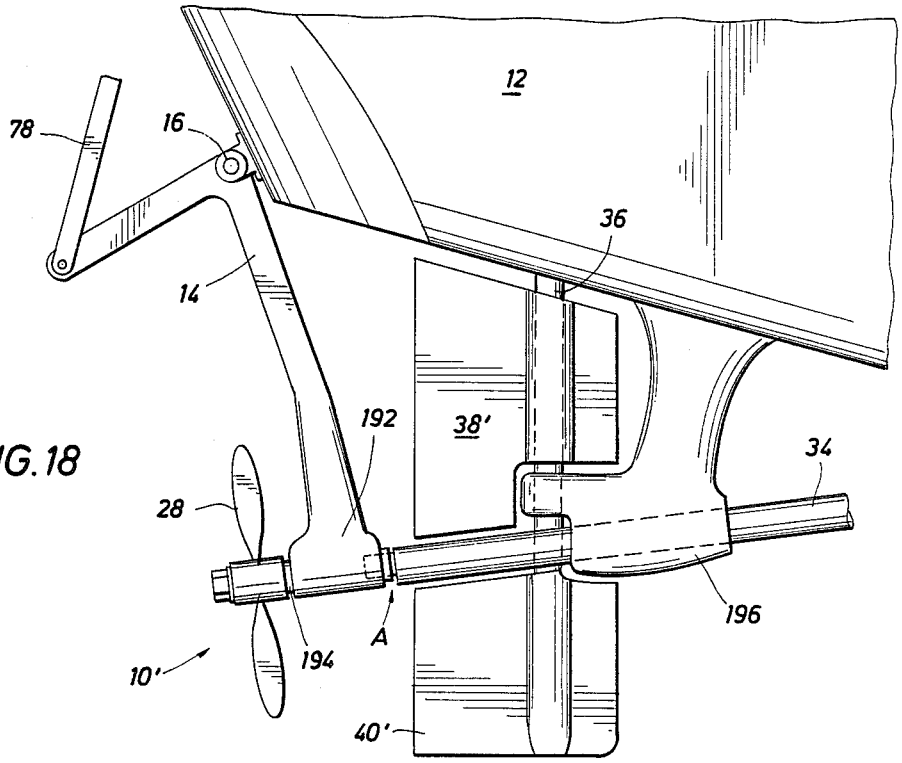
FIG. 18 is a side elevation of a portion of the stern of a vessel mounting another version of a drive assembly according to the present invention.

FIG. 18 illustrates a drive assembly 10' which includes a propeller 28 whose plane of rotation is not changeable in the operating configuration as illustrated. The propeller 28 is carried by a drive shaft 194 mounted in a housing 192 carried by the mounting system 14 and movable between operating configuration illustrated and an elevated configuration generally as described hereinbefore. In the operating configuration, the coupling at A between the propeller shaft 194 and the drive shaft 34 is automatically made up. The drive shaft is shown supported by a skeg 196, and the rudder is illustrated as provided in an upper portion 38' and a lower portion 40' which may turn with the rudder shaft 36 generally above and below the drive shaft, respectively. Thus, in the operating configuration illustrated, the propeller 28 is operable by the motor (not shown) carried by the boat 12 by rotation of the drive shaft 34 and, therefore, of the propeller shaft 194. Howeever, all steering is provided by the rudder components 38' and 40' without turning of the plane of rotation of the propeller 28. Thus, the drive assembly 10' is retractable, but does not provide additional steering by orientation of the plane of rotation of the propeller 28. Various techniques for manipulating the drive assembly 10' into and out of its operating configuration and latching the mounting system 14 in the various configurations, as well as bypassing the drive shaft 34 relative to the rudder shaft 36, in the same plane or not, as described hereinbefore may be employed with the drive assembly 10' of FIG. 18.

The present invention provides a selectively retractable drive assembly which may be positioned in an operating configuration to effect propulsion of the boat carrying the drive assembly relative to the water. In one embodiment of the drive assembly, the plane of the rotation of the propeller of the drive assembly may be oriented by the steering control of the boat to at least assist in steering of the boat through the water. The drive assembly may be retracted and withdrawn, at least in part, above the water line when not in use, or for purposes of service thereof. With the drive assembly thus retracted, the boat may be moved through the water without any drag relative thereto that would otherwise be caused by a non-operating propeller below the water line, for example.

The foregoing disclosure and description of the invention is illustrative and explanatory thereof, and various changes in the size, shape and materials as well as in the details of the illustrated constructions may be made within the scope of the appended claims without departing from the spirit of the invention.

What is claimed is:

1. Apparatus for driving marine vessles having a drive linkage to power means, comprising:

a. a drive assembly for interacting with the water in which such a vessel is positioned for moving the vessel relative to the water;

b. means for connecting said drive assembly to said drive linkage to power means for linking said drive assembly to said power means whereby said power means may operate said drive assembly; and c. mounting means whereby said drive assembly may be carried by said vessel, movable between a first configuration and a second configuration, said mounting means comprising a lever, including a first lever arm and a second lever arm carrying said drive assembly, and a pivot mounting of said lever at a location between said first and second lever arms where said lever arms meet, whereby said drive assembly may be rotated about said pivot mounting on said lever between said first and second configurations, and whereby external force may be applied to said first lever arm to move said drive assembly from said second configuration to said first configuration;

d. wherein, with said mounting means in said first configuration, said drive assembly is at least partially withdrawn from said water and, with said mounting means in said second configuration, said drive assembly in connected to said drive linkage by said connecting means for selective operation by said power means and is positioned to so move said vessel relative to said water.

2. Apparatus as defined in claim 1:

a. further comprising steering linkage to steering means carried by said vessel for steering said vessel relative to said water; and b. wherein, with said mounting means in said second configuration, said drive assembly is connected to said steering linkage for selective orientation by said steering means.

3. Apparatus as defined in claim 1 wherein said drive linkage extends under the waterline of said vessel.

4. Apparatus as defined in claim 1 wherein said drive assembly, with said mounting means in said second configuration, is so connected to said drive linkage at one connection location only.

5. Apparatus as defined in claim 2 further comprising means connected to said lever arm for selectively raising said lever arm to move said drive assembly from said second configuration to said first configuration.

6. Apparatus as defined in claim 2 further comprising latch means for locking said mounted means in said first configuration.

7. Apparatus as defined in claim 2 further comprising latch means for locking said mounting means in said second configuration.

8. Apparatus as defined in claim 2 wherein said pivot mounting comprises a pivot pin assembly including a first pin portion and a second pin portion which cooperate to form an axle by which said mounting means is pivotally mounted on said vessel and wherein said first and second pin portions may be selectively separated to release said mounting means from said vessel.

9. Apparatus as defined in claim 2 wherein said drive assembly comprises a propeller for interacting with said water.

10. Apparatus as defined in claim 9 wherein said propeller may be selectively oriented by said steering means through said steering linkage whereby said vessel may, at least in part, be steered relative to said water.

11. Apparatus as defined in claim 10 wherein said drive assembly further comprises a flexible linkage for connecting said propeller to said steering linkage whereby said propeller may be so oriented by said steering means through said steering linkage.

12. Apparatus as defined in claim 10 wherein said drive assembly comprises a gear assembly whereby said propeller may be selectively oriented by said steering means through said steering linkage.

13. Apparatus as defined in claim 10 wherein said drive assembly comprises a gear assembly for connecting said propeller to said means for connecting said drive assembly to said drive linkage while permitting said propeller to be so oriented by said steering means through said steering linakge.

14. Apparatus as defined in claim 13 wherein said gear assembly comprises at least three gears.

15. Apparatus as defined in claim 1 wherein said vessel comprises a rudder remaining in place by which said vessel may be steered with said mounting means in either said first or second configuration.

16. Apparatus as defined in claim 1 further comprising latch means for locking said mounting means in said first configuration.

17. Apparatus as defined in claim 1 further comprising latch means for locking said mounting means in said second configuration.

18. Apparatus as defined in claim 1 wherein said pivot mounting comprises a pivot pin assembly including a first pin portion and a second pin portion which cooperate to form an axle by which said mounting means is pivotally mounted on said vessel and wherein said first and second pin portions may be selectively separated to release said mounting means from said vessel.

19. Apparatus as defined in claim 1 wherein said drive assembly comprises a propeller for interacting with said water.

20. Apparatus as defined in claim 19 wherein said drive assembly further comprises a gear assembly for connecting said propeller to said means for connecting said drive assembly to said drive linkage.

21. Apparatus as defined in claim 1 wherein said vessel comprises a rudder including a first rudder section mounted above said drive linkage and movable relative thereto and a second rudder section mounted below said drive linkage and movable relative thereto.

22. Apparatus as defined in claim 1:

a. wherein said vessel comprises a rudder carried by a rudder shaft; and b. further comprising coupling means as part of at least one of said rudder shaft or said drive linkage;

c. whereby said rudder shaft and said drive linkage may be mutually aligned.

23. Apparatus as defined in claim 1 wherein said lever arm comprises a first-order lever with said pivot mounting providing the fulcrum for the lever.

24. Apparatus for driving marine vessels having a drive linkage to power means, comprising:

a. a drive assembly comprising a propeller for interacting with the water in which such a vessel is positioned, for moving the vessel relative to the water;

b. means for connecting said drive assembly to said drive linkage to power means for linking said drive assembly to said power means whereby said power means may operate said drive assembly;

c. mounting means whereby said drive assembly may be carried by said vessel, movable between a first configuration and a second configuration;

d. steering linkage to steering means carried by said vessel for steering said vessel relative to said water; and e. a flexible linkage, included in said drive assembly, and coupling means for connecting said propeller to said steering linkage whereby, with said mounting means in said second configuration, said propeller may be selectively oriented by said steering means through said steering linkage so that said vessel may, at least in part, be steered relative to said water; and f. wherein, with said mounting means in said first configuration, said drive assembly is at least partially withdrawn from said water and said means for connecting said drive assembly to said drive linkage and said coupling means are disengaged, and with said mounting means in said second configuration, said drive assembly is connected to said drive linkage by said connecting means for selective operation by said power means, said drive assembly is connected to said steering linkage by said flexible linkage and said coupling means for selective orientation of said propeller by said steering means, and said drive assembly is positioned to so move said vessel relative to said water and to so, at least in part, steer said vessel relative to said water.

25. Apparatus as defined in claim 24:

a. wherein said mounting means comprises a pivot mounting of said drive assembly on said vessel for movement of said mounting means between said first and second configurations, and said mounting means further comprises a lever arm carrying said drive assembly and so mounted on said vessel by said pivot mounting whereby said drive assembly may be rotated about said pivot mounting on said lever arm between said first and second configurations; and b. further comprising means connected to said lever arm for selectively raising said lever arm to move said drive assembly from said second configuration to said first configuration.

26. Apparatus as defined in claim 24 wherein said flexible linkage comprises a flexible cable which may transmit rotation of said steering linkage to said propeller orientation by at least partial rotation of said cable.

27. Apparatus as defined in claim 24 wherein said lever arm comprises a first-order lever with said pivot mounting providing the fulcrum for the lever.

28. Apparatus as defined in claim 24 wherein said drive linkage extends under the waterline of said vessel.

29. Apparatus as defined in claim 24 wherein said drive assembly, with said mounting means in said second configuration, is so connected to said drive linkage at one connection location only.

30. Apparatus as defined in claim 25 wherein said lever arm comprises a first-order lever with said pivot mounting providing the fulcrum for the lever.

31. Apparatus as defined in claim 25 wherein said pivot mounting comprises a pivot pin assembly including a first pin portion and a second pin portion which cooperate to form an axle by which said mounting means is pivotally mounted on said vessel and wherein said first and second pin portions may be selectively separated to release said mounting means from said vessel.

32. Apparatus as defined in claim 24 further comprising latch means for locking said mounting means in said first configuration.

33. Apparatus as defined in claim 24 further comprising latch means for locking said mounting means in said second configuration.

34. Apparatus as defined in claim 24 wherein said drive assembly comprises a gear assembly whereby said propeller may be selectively oriented by said steering means through said steering linkage.

35. Apparatus as defined in claim 24 wherein said drive assembly comprises a gear assembly for connecting said propeller to said means for connecting said drive assembly to said drive linkage while permitting said propeller to be so oriented by said steering means through said steering linkage.

36. Apparatus as defined in claim 35 wherein said gear assembly comprises at least three gears.

37. Apparatus as defined in claim 24 wherein said vessel comprises a rudder including a first rudder section mounted above said drive linkage and movable relative thereto and a second rudder section mounted below said drive linkage and movable relative thereto.

38. Apparatus as defined in claim 24:

a. wherein said vessel comprises a rudder carried by a rudder shaft; and b. further comprising coupling means as part of at least one of said rudder shaft or said drive linkage;

c. whereby said rudder shaft and said drive linkage may be mutually aligned.

39. Apparatus for driving marine vessels having a drive linkage to power means, comprising:

a. a drive assembly for interacting with the water in which such a vessel is positioned for moving the vessel relative to the water;

b. means for connecting said drive assembly to said drive linkage to power means for linking said drive assembly to said power means whereby said power means may operate said drive assembly;

c. mounting means whereby said drive assembly may be carried by said vessel, movable between a first configuration and a second configuration; and d. a rudder including a first rudder section mounted above said drive linkage and movable relative thereto and a second rudder section mounted below said drive linkage and movable relative thereto said rudder sections having a space between them, said drive linkage extending within said space;

e. wherein, with said mounting means in said first configuration, said drive assembly is at least partially withdrawn from said water and, with said mounting means in said second configuration, said drive assembly is connected to said drive linkage by said connecting means for selective operation by said power means and is positioned to so move said vessel relative to said water.

40. Apparatus as defined in claim 39 wherein said vessel comprises a rudder remaining in place by which said vessel may be steered with said mounting means in either said first or said second configuration.

41. Apparatus as defined in claim 39 wherein said drive assembly, with said mounting means in said second configuration, is so connected to said drive linkage at one connection location only.

42. Apparatus as defined in claim 39 wherein said drive linkage extends under the waterline of said vessel.

43. Apparatus as defined in claim 39:

a. wherein said rudder is carried by a rudder shaft; and b. further comprising coupling means as part of at least one of said rudder shaft or driven linkage;

c. whereby said rudder shaft and said drive linkage may be mutually aligned.

44. Apparatus as defined in claim 39:

a. further comprising steering linkage to steering means carried by said vessel for steering said vessel relative to said water; and b. wherein, with said mounting means in said second configuration, said drive assembly is connected to said steering linkage for selective orientation by said steering means.

45. Apparatus as defined in claim 44 wherein said drive assembly comprises a propeller for interacting with said water.

46. Apparatus as defined in claim 45 wherein said propeller may be selectively oriented by said steering means through said steering linkage whereby said vessel may, at least in part, be steered relative to said water.

47. Apparatus as defined in claim 46 wherein said drive assembly further comprises a flexible linkage for connecting said propeller to said steering linkage whereby said propeller may be so oriented by said steering means through said steering linkage.

48. Apparatus as defined in claim 46 wherein said drive assembly comprises a gear assembly whereby said propeller may be selectively oriented by said steering means through said steering linkage.

49. Apparatus as defined in claim 46 wherein said drive assembly comprises a gear assembly for connecting said propeller to said means for connecting said drive assembly to said drive linakge while permitting said propeller to be so oriented by said steering means through said steering linkage.

50. Apparatus as defined in claim 49 wherein said gear assembly comprises at least three gears.

51. Apparatus as defined in claim 39 wherein said drive assembly comprises a propeller for interacting with said water.

52. Apparatus as defined in claim 51 wherein said drive assembly further comprises a gear assembly for connecting said propeller to said means for connecting said drive assembly to said drive linkage.

53. Apparatus as defined in claim 39 further comprising latch means for locking said mounted means in said first configuration.

54. Apparatus as defined in claim 43 further comprising latch means for locking said mounting means in said second configuration.

* * * * *